US009994780B2

(12) United States Patent
Koseoglu

(10) Patent No.: US 9,994,780 B2
(45) Date of Patent: Jun. 12, 2018

(54) INTEGRATED ENHANCED SOLVENT DEASPHALTING AND COKING PROCESS TO PRODUCE PETROLEUM GREEN COKE

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 111 days.

(21) Appl. No.: 15/220,896

(22) Filed: Jul. 27, 2016

(65) Prior Publication Data

US 2017/0029720 A1 Feb. 2, 2017

Related U.S. Application Data

(60) Provisional application No. 62/197,342, filed on Jul. 27, 2015.

(51) Int. Cl.

| | |
|---|---|
| ***C10G 25/06*** | (2006.01) |
| ***C10G 25/12*** | (2006.01) |
| ***C10G 55/04*** | (2006.01) |
| ***C10B 55/00*** | (2006.01) |
| ***C10B 57/08*** | (2006.01) |
| ***C10G 25/00*** | (2006.01) |
| ***C10G 29/20*** | (2006.01) |
| ***C10G 53/08*** | (2006.01) |
| ***C10G 9/00*** | (2006.01) |

(52) U.S. Cl.

CPC ..... *C10G 55/04* (2013.01); *C10B 55/00* (2013.01); *C10B 57/08* (2013.01); *C10G 9/005* (2013.01); *C10G 25/00* (2013.01); *C10G 25/12* (2013.01); *C10G 29/20* (2013.01); *C10G 53/08* (2013.01); *C10G 2300/202* (2013.01); *C10G 2300/206* (2013.01)

(58) Field of Classification Search

CPC ..... C10G 9/005; C10G 21/003; C10G 25/26; C10G 25/12; C10G 55/04; C10G 2300/202; C10G 2300/206

See application file for complete search history.

(56) References Cited

U.S. PATENT DOCUMENTS

| | | | | |
|---|---|---|---|---|
| 3,227,645 | A | 1/1966 | Frumkin et al. | |
| 3,252,894 | A | 5/1966 | Gatsis et al. | |
| 4,029,749 | A * | 6/1977 | Murakami | C10B 57/08 208/131 |
| 4,239,616 | A | 12/1980 | Gearhart | |
| 4,290,880 | A | 9/1981 | Leonard | |
| 4,305,814 | A | 12/1981 | Leonard | |
| 4,411,790 | A | 10/1983 | Arod et al. | |
| 4,427,539 | A | 1/1984 | Busch et al. | |
| 4,502,944 | A | 3/1985 | Nelson | |
| 4,572,781 | A | 2/1986 | Krasuk et al. | |
| 4,663,028 | A | 5/1987 | Ditman | |
| 4,747,936 | A | 5/1988 | Penning | |
| 4,810,367 | A | 3/1989 | Chombart et al. | |
| 4,816,140 | A | 3/1989 | Trambouze et al. | |
| 4,885,080 | A | 12/1989 | Brown et al. | |
| 5,374,350 | A | 12/1994 | Heck et al. | |
| 6,558,531 | B2 | 5/2003 | Steffens et al. | |
| 6,673,234 | B2 * | 1/2004 | Li | C10G 55/04 208/131 |
| 6,783,662 | B2 | 8/2004 | Draemel et al. | |
| 6,805,790 | B2 | 10/2004 | Gupta et al. | |
| 7,566,394 | B2 * | 7/2009 | Koseoglu | C10G 21/003 208/309 |
| 2006/0175229 | A1 | 8/2006 | Montanari et al. | |
| 2007/0267327 | A1 | 11/2007 | Boakye | |
| 2008/0105595 | A1 | 5/2008 | Koseoglu | |
| 2010/0176029 | A1 * | 7/2010 | Subbiah | B01D 15/08 208/91 |
| 2015/0129460 | A1 | 5/2015 | Prasad et al. | |

OTHER PUBLICATIONS

PCT/US2016/044221, International Search Report and Written Opinion dated Nov. 23, 2016, 12 pgs.

* cited by examiner

*Primary Examiner* — Randy Boyer
(74) *Attorney, Agent, or Firm* — Abelman, Frayne & Schwab

(57) ABSTRACT

An integrated process is provided for producing deasphalted oil, high quality petroleum green coke and liquid coker products. An enhanced solvent deasphalting process is used to treat the feedstock to reduce the level of asphaltenes, N, S and metal contaminants and produce a deasphalted oil with reduced contaminants. A coking process is integrated to produce liquid and gas coking unit products, and petroleum green coke.

40 Claims, 2 Drawing Sheets

INTEGRATED ENHANCED SOLVENT DEASPHALTING AND COKING PROCESS TO PRODUCE PETROLEUM GREEN COKE

RELATED APPLICATIONS

This application claims the benefit of priority of U.S. Provisional Patent Application No. 62/197,342 filed Jul. 27, 2015, which is incorporated by reference herein.

BACKGROUND OF THE INVENTION

Field of the Invention

The invention relates to integrated enhanced solvent deasphalting and delayed coking processes for production of liquid and gas coking unit products, high quality petroleum green coke, and asphalt.

Description of Related Art

Crude oils contain heteroatomic molecules, including polyaromatic molecules, with heteroatomic constituents such as sulfur, nitrogen, nickel, vanadium and others in quantities that can adversely affect the refinery processing of the crude oil fractions. Light crude oils or condensates have sulfur concentrations as low as 0.01 percent by weight (W %). In contrast, heavy crude oils and heavy petroleum fractions have sulfur concentrations as high as 5-6 W %. Similarly, the nitrogen content of crude oils can be in the range of 0.001-1.0 W %. These impurities must be removed during refining to meet established environmental regulations for the final products (for instance, gasoline, diesel, fuel oil), or for the intermediate refining streams that are to be processed for further upgrading, such as isomerization reforming. Contaminants such as nitrogen, sulfur and heavy metals are known to deactivate or poison catalysts.

In a typical refinery, crude oil is first fractionated in the atmospheric distillation column to separate sour gas including methane, ethane, propane, butanes and hydrogen sulfide, naphtha (36-180° C.), kerosene (180-240° C.), gas oil (240-370° C.) and atmospheric residue, which are the hydrocarbon fractions boiling above 370° C. The atmospheric residue from the atmospheric distillation column is either used as fuel oil or sent to a vacuum distillation unit, depending upon the configuration of the refinery. Principal products from the vacuum distillation are vacuum gas oil, comprising hydrocarbons boiling in the range 370-520° C., and vacuum residue, comprising hydrocarbons boiling above 520° C.

Naphtha, kerosene and gas oil streams derived from crude oils or other natural sources, such as shale oils, bitumens and tar sands, are treated to remove the contaminants, such as sulfur, that exceed the specification set for the end product (s). Hydrotreating of these individual fractions is the most common refining technology used to remove these contaminants. Vacuum gas oil is processed in a hydrocracking unit to produce naphtha and diesel, or in a fluid catalytic cracking (FCC) unit to produce mainly gasoline, light cycle oil (LCO) and heavy cycle oil (HCO) as by-products, the former being used as a blending component in either the diesel pool or in fuel oil, the latter being sent directly to the fuel oil pool.

Heavier fractions from the atmospheric and vacuum distillation units can contain asphaltenes. Asphaltenes are solid in nature and comprise polynuclear aromatics, smaller aromatics and resin molecules. The chemical structures of asphaltenes are complex and include polynuclear hydrocarbons having molecular weights up to 20,000 joined by alkyl chains. Asphaltenes also include nitrogen, sulfur, oxygen and metals such as nickel and vanadium. They are present in crude oils and heavy fractions in varying quantities.

Asphaltenes exist in small quantities in light crude oils, or not at all in all condensates or lighter fractions. However, they are present in relatively large quantities in heavy crude oils and petroleum fractions. Asphaltenes have been defined as the component of a heavy crude oil fraction that is precipitated by addition of a low-boiling paraffin solvent, or paraffin naphtha, such as normal pentane, and is soluble in carbon disulfide and benzene. In certain methods their concentrations are defined as the amount of asphaltenes precipitated by addition of an n-paraffin solvent to the feedstock, for instance, as prescribed in the Institute of Petroleum Method IP-143. The heavy fraction can contain asphaltenes when it is derived from carbonaceous sources such as petroleum, coal or oil shale. There is a close relationship between asphaltenes, resins and high molecular weight polycyclic hydrocarbons. Asphaltenes are hypothesized to be formed by the oxidation of natural resins. The hydrogenation of asphaltic compounds containing resins and asphaltenes produces heavy hydrocarbon oils, that is, resins and asphaltenes are hydrogenated into polycyclic aromatic or hydroaromatic hydrocarbons. They differ from polycyclic aromatic hydrocarbons by the presence of oxygen and sulfur in varied amounts.

Upon heating above about 300-400° C., asphaltenes generally do not melt but rather decompose, forming carbon and volatile products. They react with sulfuric acid to form sulfonic acids, as might be expected on the basis of the polyaromatic structure of these components. Flocs and aggregates of asphaltenes will result from the addition of non-polar solvents, for instance, paraffinic solvents, to crude oil and other heavy hydrocarbon oil feedstocks.

Therefore, it is clear that significant measures must be taken during processing of crude oils and heavy fractions to deal with asphaltenes. Failure to do so interferes with subsequent refining operations.

There are several processing options for the heavy fractions such as vacuum residue, including hydroprocessing, coking, visbreaking, gasification and solvent deasphalting. In the solvent deasphalting process, the asphalt fraction, for instance, having 6-8 W % hydrogen, is separated from the vacuum residue by contact with a paraffinic solvent (for instance, $C_3$-$C_7$) at or below the solvents' critical temperatures and pressures. The deasphalted oil, for instance, having 9-11 W % hydrogen, is characterized as a heavy hydrocarbon fraction that is free of asphaltenes and is typically passed to other conversion units such as a hydrocracking unit or a fluid catalytic cracking unit to produce lighter, more valuable fractions.

Deasphalted oil contains a high concentration of contaminants such as sulfur, nitrogen and carbon residue which is an indicator of the coke forming properties of heavy hydrocarbons and defined as micro-carbon residue (MCR), Conradson carbon residue (CCR) or Ramsbottom carbon residue (RCR). MCR, RCR, CCR are determined by ASTM Methods D-4530, D-524 and D-189, respectively. In these tests, the residue remaining after a specified period of evaporation and pyrolysis is expressed as a percentage of the original sample. For example, deasphalted oil obtained from vacuum residue of an Arabian crude oil contains 4.4 W % of sulfur, 2,700 ppmw of nitrogen, and 11 W % of MCR. In another example, a deasphalted oil of Far East origin contains 0.14 W % sulfur, 2,500 ppmw of nitrogen, and 5.5 W % of CCR. These high levels of contaminants, and particularly nitrogen, in the deasphalted oil limit conversion in hydrocracking or FCC units. The adverse effects of nitrogen and micro-carbon residue in FCC operations have been reported to be as follows: 0.4-0.6 W % higher coke yield, 4-6 V % less gasoline yield and 5-8 V % less conversion per 1000 ppmw of nitrogen. (See Sok Yui et al., Oil and Gas Journal, Jan. 19, 1998.) Similarly, coke yield is 0.33-0.6 W % more for each one W % of MCR in the feedstock. In hydrocracking operations, the catalyst deactivation is a function of the feedstock nitrogen and MCR content. The catalyst deactivation is about 3-5° C. per 1000 ppmw of nitrogen and 2-4° C. for each one W % of MCR.

It has been established that organic nitrogen is the most detrimental catalyst poison present in the hydrocarbon streams from the sources identified above. Organic nitrogen compounds poison the active catalytic sites resulting in catalyst deactivation, which in turn reduces catalyst cycle process length, catalyst lifetime, product yields, and product quality, and also increases the severity of operating conditions and the associated cost of plant construction and operations. Removing nitrogen, sulfur, metals and other contaminants that poison catalysts will improve refining operations and will have the advantage of permitting refiners to process more and/or heavier feedstocks.

In coking processes, heavy feeds are thermally decomposed to produce coke, gas and liquid product streams of varying boiling ranges. Coke is generally treated as a low value by-product. It is removed from the units and can be recovered for various uses depending on its quality.

The use of heavy crude oils having high metals and sulfur content as an initial feed is of interest due to its lower market value. Traditional coking processes using these feeds produce coke which has substantial sulfur and metal content. The goal of minimizing air pollution is a further incentive for treating residuum in a coking unit since the gases and liquids produced contain sulfur in a form that can be relatively easily removed.

While individual and discrete solvent deasphalting and coking operations are well developed and suitable for their intended purposes, there remains a need for improved processes using heavy feeds having asphaltenes, N, S and metal contaminants.

SUMMARY OF THE INVENTION

An integrated system and process is provided for producing liquid coker products, high quality petroleum green coke, and asphalt. An enhanced solvent deasphalting process is used to treat the feedstock to reduce the level of asphaltenes, N, S and metal contaminants and produce a deasphalted oil with reduced contaminants. A coking process is integrated so that the deasphalted oil with reduced contaminants is the coking unit feedstock, facilitating production coker liquid and gas fractions and recovery of petroleum green coke.

In certain embodiments of the integrated process, which can be carried out within refinery limits, use of the deasphalted oil intermediate stream as feed to the coking unit enables recovery of high quality petroleum coke that can be used as raw material to produce low sulfur marketable grades of coke including anode grade coke (sponge) and/or electrode grade coke (needle).

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figure 1:
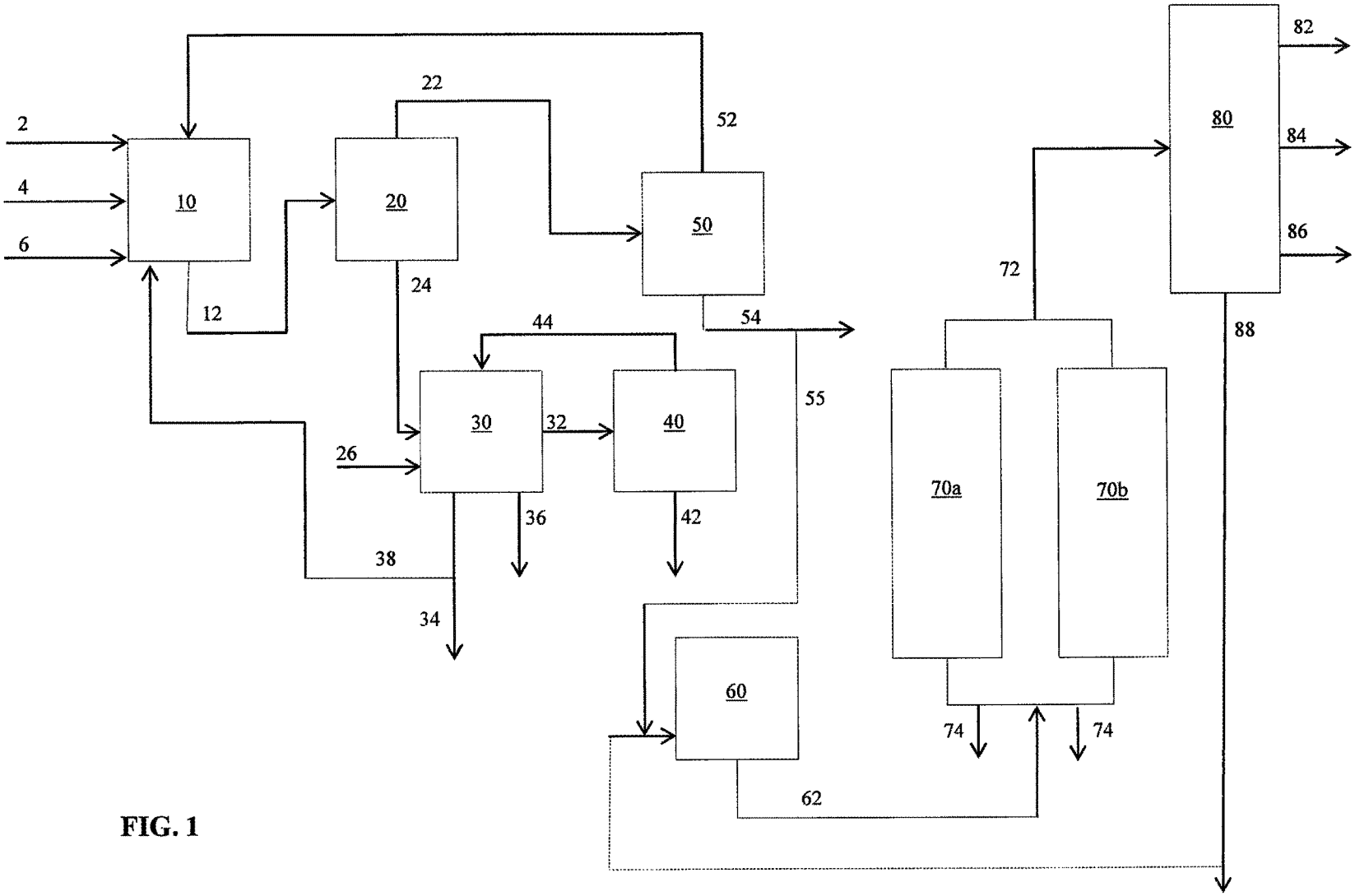
FIG. 1 is a process flow diagram of one embodiment of an integrated enhanced solvent deasphalting and coking process.

The process and system herein facilitates production of coker liquid and gas fractions and petroleum green coke from heavy crude oils or fractions having asphaltenes, metal and sulfur content that typically has lower market value compared to light crude oils or fractions. Enhanced solvent deasphalting processes, such as those described in commonly owned U.S. Pat. No. 7,566,394, which is incorporated by reference herein in its entirety, are used to process the heavy crude oils or fractions. The deasphalted oil is thermally cracked in a coking unit, such as a delayed coking unit. In contrast to typical coking operations in which the coke is low market value by-product, in the integrated process herein, using as an initial feed heavy crude oils or fractions having reduced asphaltenes, metal and sulfur content, petroleum green coke recovered from the coker unit drums is low in sulfur and metals. The recovered petroleum green coke can be used as high quality, low sulfur and metal content fuel grade (shot) coke, and/or a raw material for production of marketable grades of coke including anode grade coke (sponge) and/or electrode grade coke (needle).

The deasphalted oil is thermally cracked in a coking unit, such as a delayed coking unit. In contrast to typical coking operations in which the coke is low market value by-product, in the integrated process herein, high quality petroleum green coke recovered from the coker unit drums is low in sulfur and metals. The recovered high quality petroleum green coke can be used as high quality, low sulfur and metal content fuel grade (shot) coke, and/or a raw material for production of low sulfur and metal content marketable grades of coke including anode grade coke (sponge) and/or electrode grade coke (needle). Table 1 shows the properties of these types of coke. In accordance with certain embodiments of the process herein, calcination of the petroleum green coke recovered from the coking drums produces sponge and/or needle grade coke, for instance, suitable for use in the aluminum and steel industries. Calcination occurs by thermal treatment to remove moisture and reduce the volatile combustible matter.

TABLE 1

| Property | Units | Fuel Coke | Calcined Sponge Coke | Calcined Needle Coke |
|---|---|---|---|---|
| Bulk Density | $Kg/m^3$ | 880 | 720-800 | 670-720 |
| Sulfur | W % (max) | 3.5-7.5 | 1.0-3.5 | 0.2-0.5 |
| Nitrogen | ppmw (max) | 6,000 | — | 50 |
| Nickel | ppmw (max) | 500 | 200 | 7 |
| Vanadium | ppmw | 150 | 350 | — |

TABLE 1-continued

| Property | Units | Fuel Coke | Calcined Sponge Coke | Calcined Needle Coke |
|---|---|---|---|---|
| Volatile Combustible Material | W % (max) | 12 | 0.5 | 0.5 |
| Ash Content | W % (max) | 0.35 | 0.40 | 0.1 |
| Moisture Content | W % (max) | 8-12 | 0.3 | 0.1 |
| Hardgrove Grindability Index (HGI) | W % | 35-70 | 60-100 | — |
| Coefficient of thermal expansion, E + 7 | ° C. | — | — | 1-5 |

As used herein, "high quality petroleum green coke" refers to petroleum green coke recovered from a coker unit that when calcined, possesses the properties as in Table 1, and in certain embodiments possessing the properties in Table 5 concerning calcined sponge coke or calcined needle coke identified in Table 1.

As used herein, a process that operates "within the battery limits of a refinery" refers to a process that operates with a battery of unit operations along with their related utilities and services, distinguished from a process whereby effluent from a unit operation is collected, stored and/or transported to a separate unit operations or battery of unit operations.

In one embodiment, of a process herein, which can be carried out within the battery limits of a refinery and on a continuous or semi-continuous basis, a heavy hydrocarbon feedstock is subjected to enhanced solvent deasphalting in the presence of an effective quantity of solid adsorbent material to adsorb sulfur-containing compounds or nitrogen-containing polynuclear aromatic molecules concurrently with solvent assisted removal of asphaltenes. Contaminants are adsorbed and the solvent and deasphalted oil fraction is removed as a separate stream from which the solvent is recovered for recycling. The adsorbent having contaminants adsorbed thereon and the asphalt bottoms are mixed with aromatic and/or polar solvents to desorb the contaminants and washed as necessary to clean the adsorbent, which can preferably be recovered and recycled. The solvent-asphalt mixture is sent to a fractionator for recovery and recycling of the aromatic or polar solvent. Bottoms from the fractionator include the desorbed contaminants are further processed as appropriate. The deasphalted oil having reduced contaminants is thermally cracked in a coking unit, such as a delayed coking unit, and coker liquid and gas products are recovered, along with high quality petroleum green coke.

In another embodiment, a heavy hydrocarbon feedstock is subjected to a first separation step in a solvent deasphalting process to produce a primary deasphalted oil phase and discharge a primary asphalt phase. An effective quantity of solid adsorbent material mixed with the primary deasphalted oil phase, which contains the deasphalted oil and paraffinic solvent. Sulfur-containing and/or nitrogen-containing polynuclear aromatic molecules in the deasphalted oil are adsorbed by the solid adsorbent material. The paraffinic solvent is separated from the deasphalted oil and adsorbent material, and the solvent is recovered for recycling. A slurry containing the adsorbent having contaminants adsorbed thereon and deasphalted oil is mixed with aromatic and/or polar solvents to desorb the contaminants, and washed as necessary to clean the adsorbent, which can preferably be recovered and recycled. The deasphalted oil mixture is sent to a fractionator for recovery and recycling of the aromatic and/or polar solvents. The deasphalted oil having reduced contaminants is thermally cracked in a coking unit, such as a delayed coking unit, and coker liquid and gas products are recovered, along with high quality petroleum green coke.

The solid adsorbent material can be selected from the group consisting of clay (for instance, attapulgus clay), silica, alumina, silica-alumina, titania-silica, activated carbon, molecular sieves, fresh zeolitic catalyst materials, used zeolitic catalyst materials, and combinations comprising one or more of the foregoing. The material is provided in particulate form of suitable dimension, such as granules, extrudates, tablets, spheres, or pellets of a size in the range of 4-60 mesh. The quantity of the solid adsorbent material used in the embodiments herein is about 0.1:1 to 20:1 W/W, and preferably about 1:1 to 10:1 W/W (feed-to-adsorbent).

In the herein embodiments, the coking unit is integrated with an enhanced solvent deasphalting process to produce coker liquid and gas products and recover high quality petroleum green coke suitable for production of marketable coke from the starting heavy hydrocarbon feedstock. Advantageously, the integrated processes herein facilitate recovery of such high quality petroleum green coke since the feed to the delayed coking unit has desirable qualities. In particular, the deasphalted oil stream in the present process is characterized by a sulfur content of generally less than about 3.5 wt %, in certain embodiments less than about 2.5 wt % and in further embodiments less than about 1 wt %, and a metals content of less than about 700 ppmw, in certain embodiments less than about 400 ppmw and in further embodiments less than about 100 ppmw. Use of this feedstream results in a high quality petroleum coke product that can be used as raw material to produce low sulfur marketable grades of coke including anode grade coke (sponge) and/or electrode grade coke (needle), in an efficient integrated process.

Coking is a carbon rejection process in which low-value atmospheric or vacuum distillation bottoms are converted to lighter products which in turn can be hydrotreated to produce transportation fuels, such as gasoline and diesel. Conventionally, coking of residuum from heavy high sulfur, or sour, crude oils is carried out primarily as a means of utilizing such low value hydrocarbon streams by converting part of the material to more valuable liquid and gas products. Typical coking processes include delayed coking and fluid coking.

In the delayed coking process, feedstock is typically introduced into a lower portion of a coking feed fractionator where one or more lighter materials are recovered as one or more top fractions, and bottoms are passed to a coking furnace. In the furnace bottoms from the fractionator and optionally heavy recycle material are mixed and rapidly heated in a coking furnace to a coking temperature, for instance, in the range of 480° C. to 530° C., and then fed to a coking drum. The hot mixed fresh and recycle feedstream is maintained in the coke drum at coking conditions of temperature and pressure where the feed decomposes or cracks to form coke and volatile components.

Table 2 provides delayed coker operating conditions for production of certain grades of petroleum green coke in the process herein:

TABLE 2

| Variable | Unit | Fuel Coke | Sponge Coke | Needle Coke |
|---|---|---|---|---|
| Temperature | ° C. | 488-500 | 496-510 | 496-510 |
| Pressure | $Kg/cm^2$ | 1 | 1.2-4.1 | 3.4-6.2 |
| Recycle Ratio | % | 0-5 | 0-50 | 60-120 |
| Coking time | hours | 9-18 | 24 | 36 |

The volatile components are recovered as vapor and transferred to a coking product fractionator. One or more heavy fractions of the coke drum vapors can be condensed, for instance quenching or heat exchange. In certain embodiments the contact the coke drum vapors are contacted with heavy gas oil in the coking unit product fractionator, and heavy fractions form all or part of a recycle oil stream having condensed coking unit product vapors and heavy gas oil. In certain embodiments, heavy gas oil from the coking feed fractionator is added to the flash zone of the fractionator to condense the heaviest components from the coking unit product vapors.

Coking units are typically configured with two parallel drums and operated in a swing mode. When the coke drum is full of coke, the feed is switched to another drum, and the full drum is cooled. Liquid and gas streams from the coke drum are passed to a coking product fractionator for recovery. Any hydrocarbon vapors remaining in the coke drum are removed by steam injection. The coke remaining in the drum is typically cooled with water and then removed from the coke drum by conventional methods, for instance, using hydraulic and/or mechanical techniques to remove green coke from the drum walls for recovery.

Recovered petroleum green coke is suitable for production of marketable coke, and in particular anode (sponge) grade coke effective for use in the aluminum industry, or electrode (needle) grade coke effective for use in the steel industry. In the delayed coking production of high quality petroleum green coke, unconverted pitch and volatile combustible matter content of the green coke intermediate product subjected to calcination should be no more than about 15 percent by weight, and preferably in the range of 6 to 12 percent by weight.

In certain embodiments, one or more catalysts and additives can be added to the fresh feed and/or the fresh and recycle oil mixture prior to heating the feedstream in the coking unit furnace. The catalyst can promote cracking of the heavy hydrocarbon compounds and promote formation of the more valuable liquids that can be subjected to hydrotreating processes downstream to form transportation fuels. The catalyst and any additive(s) remain in the coking unit drum with the coke if they are solids, or are present on a solid carrier. If the catalyst(s) and/or additive(s) are soluble in the oil, they are carried with the vapors and remain in the liquid products. Note that in the production of high quality petroleum green coke, catalyst(s) and/or additive(s) which are soluble in the oil can be favored in certain embodiments to minimize contamination of the coke.

The feed to the embodiments of the enhanced solvent deasphalting systems herein can be a heavy hydrocarbon stream such as crude oils, bitumens, heavy oils, shale oils and refinery streams that include atmospheric and vacuum residues, fluid catalytic cracking slurry oils, coker bottoms, visbreaking bottoms and coal liquefaction by-products and mixtures thereof having asphaltenes, sulfur, nitrogen and polynuclear aromatic molecules, for instance, that typically reduce the market value of the material compared to similar streams having lesser quantities of these constituents.

For the purpose of this simplified schematic illustrations and description, the numerous valves, pumps, temperature sensors, electronic controllers and the like that are customarily employed in refinery operations and that are well known to those of ordinary skill in the art are not shown.

Referring to FIG. 1, an embodiment of an integrated enhanced solvent deasphalting and coking process and system is shown, includes a mixing vessel 10, a first separation vessel 20, a filtration vessel 30, a fractionator 40, a second separation vessel 50, a coking unit furnace 60, delayed coking drums 70*a* and 70*b*, and a coking product fractionator 80.

In a process for producing high quality petroleum green coke and coker liquid and gas products operation of a system according to FIG. 1, a heavy hydrocarbon feedstream 2, a paraffinic solvent 4 and solid adsorbent slurry 6 having an effective quantity of solid adsorbent material are introduced into the mixing vessel 10. Mixing vessel 10 is equipped with suitable mixing means, for instance, rotary stirring blades or paddles, which provide a gentle, but thorough mixing of the contents.

The rate of agitation for a given vessel and mixture of adsorbent, solvent and feedstock is selected so that there is minimal, if any, attrition of the adsorbent granules or particles. The mixing is continued for 30 to 150 minutes, the duration being related to the components of the mixture.

The mixture of heavy oil 2, paraffinic solvent 4 and solid adsorbent 6 is discharged through line 12 to a first separation vessel 20 at a temperature and pressure that is below the critical temperature and pressure of the solvent to separate the feed mixture into an upper layer comprising light and less polar fractions that are removed as stream 22 and bottoms comprising asphaltenes and the solid adsorbent 24. A vertical flash drum can be utilized for this separation step.

Conditions in the mixing vessel and first separation vessel are maintained below the critical temperature and pressure of the solvent. In certain embodiments the solvent selected for use in the mixing vessel and first separation vessel in the enhanced solvent deasphalting process herein is a $C_3$ to $C_7$ paraffinic solvent. The following Table 3 provides critical temperature and pressure data for $C_3$ to $C_7$ paraffinic solvents:

TABLE 3

| Carbon Number | Temperature, ° C. | Pressure, bar |
|---|---|---|
| $C_3$ | 97 | 42.5 |
| $C_4$ | 152 | 38.0 |
| $C_5$ | 197 | 34.0 |
| $C_6$ | 235 | 30.0 |
| $C_7$ | 267 | 27.5 |

The asphalt and adsorbent slurry 24 is mixed with an aromatic and/or polar solvent stream 26 in a filtration vessel 30 to separate and clean the adsorbent material. The solvent stream 26 can include benzene, toluene, xylenes, tetrahydrofuran, methylene chloride. Solvents can be selected based on their Hildebrand solubility factors or on the basis of two-dimensional solubility factors. The overall Hildebrand solubility parameter is a well-known measure of polarity and has been tabulated for numerous compounds. (See, for example, *Journal of Paint Technology*, Vol. 39, No. 505, February 1967). The solvents can also be described by two-dimensional solubility parameters, that is, the complexing solubility parameter and the field force solubility parameter. (See, for example, I. A. Wiehe, Ind. & Eng. Res., 34(1995), 661). The complexing solubility parameter component which describes the hydrogen bonding and electron donor-acceptor interactions measures the interaction energy that requires a specific orientation between an atom of one molecule and a second atom of a different molecule. The field force solubility parameter which describes van der Waal's and dipole interactions measures the interaction energy of the liquid that is not impacted by changes in the orientation of the molecules.

In certain embodiments the polar solvent, or solvents, if more than one is employed, used in filtration vessel 30 has an overall solubility parameter greater than about 8.5 or a complexing solubility parameter of greater than one and a field force parameter value greater than 8. Examples of polar solvents meeting the desired solubility parameter are toluene (8.91), benzene (9.15), xylene (8.85), and tetrahydrofuran (9.52). Preferred polar solvents for use in the practice of the invention are toluene and tetrahydrofuran.

In certain embodiments, the adsorbent slurry and asphalt mixture 24 is washed with two or more aliquots of the aromatic or polar solvent 26 in the filtration vessel 30 in order to dissolve and remove the adsorbed compounds. The clean solid adsorbent stream 38, is recovered and recycled to the mixing vessel 10, an asphalt stream 36 is recovered, and spent adsorbent is discharged 34. A solvent-asphalt mixture 32 is withdrawn from the filtering vessel 30 and sent to a fractionator 40 to separate the solvent from the asphalt containing heavy polynuclear aromatic compounds which are withdrawn as stream 42 for appropriate disposal. The clean aromatic and/or polar solvent is recovered as stream 44 and recycled to filtration vessel 30.

The recovered deasphalted oil and solvent stream from the first separation vessel 22 is introduced into a second separation vessel 50 maintained at an effective temperature and pressure to separate solvent from the deasphalted oil, such as between the solvent's boiling and critical temperature, under a pressure of between one and three bars. The solvent stream 52 is recovered and returned to the mixing vessel 10, in certain embodiments in a continuous operation. The deasphalted oil stream 54 is discharged from the bottom of the vessel 50.

In one example, analyses for sulfur using ASTM D5453, nitrogen using ASTM D5291, and metals (nickel and vanadium) using ASTM D3605 indicate that the oil has a greatly reduced level of contaminants, that is, it contains no metals, and about 80 W % of the nitrogen and 20-50 W % of the sulfur which were present in the original feedstream have been removed.

A portion 55 (for instance, 10-100%) of the discharged deasphalted oil stream 54 is processed a coking operation to produce coker gas and liquid products and high quality petroleum green coke. In certain embodiments, as shown in FIG. 1, a delayed coking operation is used. The discharged deasphalted oil stream 55 is charged to a delayed coking furnace 60 where the contents are rapidly heated to an effective coking temperature, such as the range of about 480° C. to 530° C., and then fed to delayed coking drum 70*a* or 70*b*. In certain embodiments, two or more parallel coking drums 70*a* and 70*b* are provided and are operated in swing mode, such that when one of the drums is filled with coke, the deasphalted oil stream is transferred to the empty parallel drum and coke, in certain embodiments anode grade coke, is recovered from the filled drum 74. A liquid and gas delayed coker product stream 72 is recovered from the coker drum 70*a* or 70*b*. Any hydrocarbon vapors remaining in the coke drum can be removed by steam injection.

The liquid and gas delayed coker product stream 72 is introduced into a coking product stream fractionator where it is fractionated to yield separate product streams that can include a light gas stream 82, a coker naphtha stream 84, a light coker gas oil stream 86 and a heavy coker gas oil stream 88. Optionally, all or a portion of the heavy coker gas oil stream 88 is recycled to the coking unit furnace 60.

The coke remaining in coker drum 70*a* or 70*b* is cooled, for instance, water quenched, and removed from the coke drum as recovered coke product 74. The coke can be removed by mechanical or hydraulic operations. For instance, coke can be cut from the coke drum with a high pressure water nozzle. According to the process herein, the recovered coke is high quality petroleum green coke.

Advantageously, the integrated process facilitates production of high quality petroleum green coke from the coking operation since the intermediate feed thereto, the deasphalted/desulfurized oil stream, has desirable qualities, that is, low content of asphaltenes and sulfur-containing and nitrogen-containing polynuclear aromatics.

Figure 2:
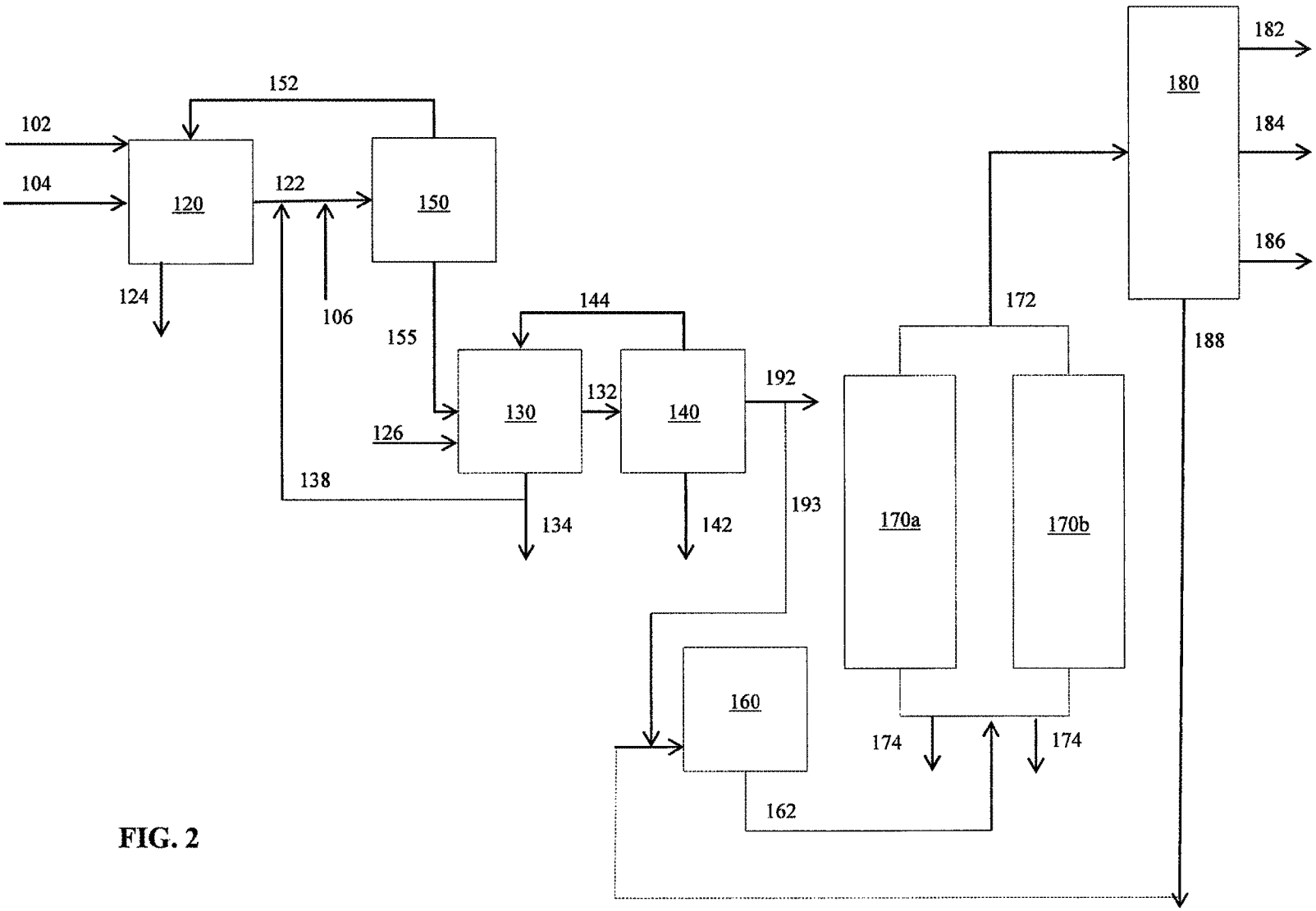
FIG. 2 is a process flow diagram of a second embodiment of an integrated enhanced solvent deasphalting and coking process.

FIG. 2 depicts another embodiment of an integrated enhanced solvent deasphalting and coking process and system. The system includes a first separation vessel 120, a second separation vessel 150, a filtration vessel 130, a fractionator 140, a coking unit furnace 160, delayed coking drums 170*a* and 170*b*, and a coking product fractionator 180.

In a process for producing high quality petroleum green coke and coker liquid and gas products operation of a system according to FIG. 2, a heavy hydrocarbon feedstream 102 and a paraffinic solvent 104 are introduced into a first separation zone 120 in which asphalt is separated from the feedstream and discharged from the first separation zone 120 as stream 124. Conditions in the first separation vessel are maintained below the critical temperature and pressure of the solvent. In certain embodiments the solvent selected for use in the first separation vessel in the enhanced solvent deasphalting process herein is a $C_3$ to $C_7$ paraffinic solvent.

A combined deasphalted oil and solvent stream 122 is discharged from the first separation zone 120 and mixed with an effective quantity of solid adsorbent material 106.

The deasphalted oil, solvent, and solid adsorbent mixture is passed to the second separation zone 150 where the mixture is maintained at an effective temperature and pressure to separate solvent from the deasphalted oil, such as between the solvent's boiling and critical temperature, under a pressure of between one and three bars. In addition, the mixture is maintained in the second separation zone 150 for a time sufficient to adsorb on the adsorbent material any remaining asphaltenes and/or sulfur-containing polynuclear aromatic molecules and/or nitrogen-containing polynuclear aromatic molecules. The solvent is then separated and recovered from the deasphalted oil and adsorbent material and recycled as stream 152 to the first separation zone 120.

A slurry 155 of deasphalted oil and adsorbent from the second separation vessel 150 is mixed with an aromatic and/or polar solvent stream 126 in a filtration vessel 130 to separate and clean the adsorbent material. The solvent stream 126 can include benzene, toluene, xylenes, tetrahydrofuran, methylene chloride. Solvents can be selected based on their Hildebrand solubility factors or on the basis of two-dimensional solubility factors as discussed above.

In certain embodiments, the deasphalted oil and adsorbent mixture 155 is preferably washed with two or more aliquots of aromatic or polar solvent 126 in the filtration vessel 130 in order to dissolve and remove the adsorbed sulfur-containing and nitrogen-containing compounds. The clean solid adsorbent stream 138, is recovered and recycled for mixing with the deasphalted oil stream 122. Spent adsorbent material is discharged from the filtration vessel as stream 134. The deasphalted oil and solvent mixture 132 is passed from the filtration vessel 130 to the fractionator 140 to separate the solvent from the asphalt containing heavy polynuclear aromatic compounds which are withdrawn as stream 142 for appropriate disposal. The clean aromatic and/or polar solvent is recovered as stream 144 and recycled to filtration vessel 130.

A portion 193 (for instance, 10-100%) discharged deasphalted oil stream 192 is processed a coking operation to produce coker gas and liquid products and high quality petroleum green coke. In certain embodiments, as shown in FIG. 2, a delayed coking operation is used. The discharged deasphalted oil stream 193 is charged to a delayed coking furnace 160 where the contents are rapidly heated to an effective coking temperature, such as the range of about 480° C. to 530° C., and then fed to delayed coking drum 170*a* or 170*b*. In certain embodiments, two or more parallel coking drums 170*a* and 170*b* are provided and are operated in swing mode, such that when one of the drums is filled with coke, the deasphalted oil stream is transferred to the empty parallel drum and coke is recovered from the filled drum 174. A liquid and gas delayed coker product stream 172 is recovered from the coker drum 170*a* or 170*b*. Any hydrocarbon vapors remaining in the coke drum can be removed by steam injection.

The liquid and gas delayed coker product stream 172 is introduced into a coking product stream fractionator where it is fractionated to yield separate product streams that can include a light gas stream 182, a coker naphtha stream 184, a light coker gas oil stream 186 and a heavy coker gas oil stream 188. Optionally, all or a portion of the heavy coker gas oil stream 188 is recycled to the coking unit furnace 160.

The coke remaining in coker drum 170*a* or 170*b* is cooled, for instance, water quenched, and removed from the coke drum as recovered coke product 174. The coke can be removed by mechanical or hydraulic operations. According to the process herein, the recovered coke is high quality petroleum green coke.

By integrating an enhanced solvent deasphalting process with a delayed coking process, the deasphalted oil feedstream to the coking unit does not contain sulfur-containing and nitrogen-containing polynuclear aromatic molecules, thereby resulting in the production of high quality petroleum green coke. Moreover, by recycling both solvents as well as the solid adsorbent material, economic and environmental advantages are achieved. In certain embodiments, when activated carbon is used as an adsorbent in the solvent deasphalting unit before or after the desorption step, it can be used as fuel, for instance, in associated power plants.

Computer models can be used advantageously in evaluating whether process modifications are technically feasible and economically justifiable. The use of computer modeling is described by J. F. Schabron and J. G. Speight in an article entitled "An Evaluation of the Delayed-Coking Product Yield of Heavy Feedstocks Using Asphaltenes Content and Carbon Residue", Oil & Gas Science and Technology—Rev. IFP, Vol. 52 (1997), No. 1, pp. 73-85. A coking process model commonly used in the industry was modified to reflect the presence of light components and the corresponding yields based on the mid-boiling temperatures of the respective cuts. The model also included experimental data regarding the characteristics of the feedstream. Three types of residual oils were delayed coked at the same conditions to see the impact of feedstock quality on the product yields and coke quality. The properties of the feedstocks are summarized in Table 4. The feedstream are subjected to delayed coking at a temperature of 496° C. from the furnace outlet and at atmospheric pressure.

TABLE 4

| Property | Arab Heavy Vacuum Residue | DOA-SDA | DAO-ESDA |
|---|---|---|---|
| API Gravity, ° | 9 | 14.16 | 14.5 |
| SG | 1.007 | 0.971 | 0.969 |
| Sulfur, W % | 4.38 | 3.31 | 2.9 |
| Nitrogen, W % | 0.4833 | 0.0835 | 0.017 |
| CCR, W % | 24.3 | 7.32 | 4.1 |
| Nickel, ppmw | 59 | 2 | 0.1 |
| Vanadium, ppmw | 182 | 8 | 0.1 |

DAO-SDA: Solvent deasphalted oil using conventional solvent deasphalting technology DAO-ESDA: Solvent deasphalted oil using enhanced solvent deasphalting technology (with adsorbents)

The Arab heavy residue is the heaviest and dirties of the oil tested and DAO-ESDA is the cleanest oil tested. The product yields from the delayed coking operations are shown in Table 5.

TABLE 5

| | Arab Heavy Vacuum Residue | DOA-SDA | DAO-ESDA |
|---|---|---|---|
| Yields, W % | | | |
| Coke | 38.9 | 11.7 | 6.6 |
| Gas | 11.3 | 8.9 | 8.4 |
| Naphtha | 19.6 | 13.8 | 12.7 |
| Light Coker Gas Oil | 17.3 | 36.9 | 37.8 |
| Heavy Coker Gas Oil | 12.9 | 28.7 | 34.6 |
| Total | 100.0 | 100.0 | 100.0 |

Arab heavy vacuum residue yielded the highest amount of coke (38.9 W %) and a substantial drop 70 W % is observed when the vacuum residue is deasphalted. When the vacuum residue is solvent deasphalted with adsorbents, and the deasphalted the coke yield decreased further by 83 W % to 6.6 W %.

The sulfur and metals levels are also calculated for the three feedstock and summarized in Table 6.

TABLE 6

| | Arab Heavy Vacuum Residue | DOA-SDA | DAO-ESDA | *Specification |
|---|---|---|---|---|
| Sulfur, W % | 7.5 | 4.5 | 3.2 | 1-3.5 |
| Metals, ppmw | 620 | 85 | 3 | 550 |

*Anode grade coke

As seen the deasphalted oil obtained from enhanced solvent deasphalting unit, which utilizes adsorbent, produces high coke meeting the anode grade coke specification.

Petroleum green coke recovered from a delayed coker unit is subjected to calcination. In particular, samples of about 3 kg of Petroleum green coke were calcined according to the following heat-up program: Room Temperature to 200° C. at 200° C./h heating rate; 200° C. to 800° C. at 30° C./h heating rate; 800° C. to 1100° C. at 50° C./h heating rate; Soaking Time at 1,100° C.: 20 h.

Table 7 shows the properties of the samples of petroleum green coke and Table 8 shows the properties of the calcium samples.

TABLE 7

| Property | Method | Unit | Range | Sample 1 | Sample 2 |
|---|---|---|---|---|---|
| Water Content | ISO 11412 | % | 6.0-15.0 | 0.0 | 0.0 |
| Volatile Matter | ISO 9406 | % | 8.0-12.0 | 4.8 | 5.9 |
| Hardgrove Grindability Index | ISO 5074 | — | 60-100 | 41 | 50 |
| XRF Analysis | ISO | %/ | 0.50-4.00 | 3.40 | 3.36 |
| S V Ni Si Fe Al Na Ca | 12980 | ppm | 50-350 | 83 | 76 |
| P | | | 50-220 | 80 | 77 |
| K Mg | | | 20-250 | 71 | 45 |
| Pb | | | 50-400 | 92 | 154 |
| | | | 50-250 | 71 | 45 |
| | | | 20-120 | 44 | 27 |
| | | | 20-120 | 18 | 13 |
| | | | 1-20 | 2 | 1 |
| | | | 5-15 | 0 | 0 |
| | | | 10-30 | 13 | 11 |
| | | | 1-5 | 0 | 0 |
| Ash Content | ISO 8005 | % | 0.10-0.30 | 0.08 | 0.08 |

TABLE 8

| Property | Method | Unit | Range | Sample 1 | Sample 2 |
|---|---|---|---|---|---|
| Water Content | ISO 11412 | % | 0.0-0.2 | 0.0 | 0.0 |
| Volatile Matter | ISO 9406 | % | 0.0-0.5 | 0.3 | 0.5 |
| Hardgrove Grindability Index | ISO 5074 | — | — | 41 | 49 |
| Ash Content | ISO 8005 | % | 0.10-0.30 | 0.04 | 0.07 |

The method and system of the present invention have been described above and in the attached drawings; however, modifications will be apparent to those of ordinary skill in the art and the scope of protection for the invention is to be defined by the claims that follow.

The invention claimed is:

1. An integrated process that operates within the battery limits of a refinery for conversion of a heavy hydrocarbon feedstock containing asphaltenes, sulfur-containing and nitrogen-containing polynuclear aromatic molecules comprising:

a. mixing the heavy hydrocarbon feedstock, paraffinic solvent and an effective quantity of solid adsorbent material
   at a temperature and pressure that are below the critical pressure and temperature of the solvent to promote solvent-flocculation of solid asphaltenes
   and
   for a time sufficient to adsorb the sulfur-containing and nitrogen-containing polynuclear aromatic molecules on the solid adsorbent material;

b. passing the heavy hydrocarbon feedstock, paraffinic solvent and solid adsorbent material to a first separation vessel;

c. separating a solid phase comprising asphaltenes and solid adsorbent material from a liquid phase comprising deasphalted oil and paraffinic solvent;

d. passing the solid phase to a filtration vessel with an aromatic and/or polar solvent to desorb the adsorbed contaminants and to recover regenerated solid adsorbent material;

e. passing the liquid phase to a second separation vessel to separate deasphalted oil and paraffinic solvent, and optionally recycling at least a portion of the separated paraffinic solvent to step (a);

f. passing deasphalted oil from the second separation vessel to a coking unit;

g. thermally cracking the deasphalted oil in a coking unit to produce liquid and gas coking products; and h. recovering petroleum green coke from the coking unit.

2. The process of claim 1 wherein the coke has bulk density in the range 720-800 Kg/m$^3$.

3. The process of claim 1 wherein the coke contains sulfur in the range 1 to 2.5 W %.

4. The process of claim 1 wherein the coke contains nickel up to 200 ppmw.

5. The process of claim 1 wherein the coke contains vanadium up to 350 ppmw.

6. The process of claim 1 wherein the coke contains volatile combustible material up to 0.5 W %.

7. The process of claim 1 wherein the deasphalted oil is heated in a furnace of the coking unit to a temperature in the range of 480° C. to 530° C.

8. The process of claim 1 wherein the coker unit is a delayed coker unit.

9. The process of claim 8, wherein the coker unit is configured with two or more parallel drums and is operated in a swing mode, and wherein the process is continuous.

10. The process of claim 1, wherein the petroleum green coke recovered from the coker drum effective raw material for calcination into anode grade coke (sponge) or electrode grade coke (needle).

11. An integrated process that operates within the battery limits of a refinery for conversion of a heavy hydrocarbon feedstock containing asphaltenes, sulfur-containing and nitrogen-containing polynuclear aromatic molecules comprising:

a. mixing the heavy hydrocarbon feedstock and paraffinic solvent in a first separation vessel at a temperature and pressure that are below the critical pressure and temperature of the paraffinic solvent to promote solvent-flocculation of solid asphaltenes;

b. discharging an asphalt stream from the first separation vessel;

c. passing a mixed deasphalted oil and paraffinic solvent stream from the first separation vessel, and an effective quantity of solid adsorbent material, to a second separation vessel;

d. maintaining the mixture in the second separation vessel for a time sufficient for adsorption by the solid adsorbent material of asphaltenes and/or sulfur-containing polynuclear aromatic molecules and/or nitrogen-containing polynuclear aromatic molecules remaining in the deasphalted oil;

e. separating and recovering at least a portion of the paraffinic solvent from the deasphalted oil and adsorbent material;

f. passing deasphalted oil and solid adsorbent material from the second separation vessel to a filtration vessel with an aromatic and/or polar solvent to desorb the adsorbed contaminants and to recover regenerated solid adsorbent material;

g. passing the deasphalted oil and aromatic or polar solvent mixture to a fractionator to recover the aromatic and/or polar solvent, and deasphalted oil;

h. passing the deasphalted oil from the fractionator to a coking unit;

i. thermally cracking the deasphalted oil in a coking unit to produce a delayed coking product stream comprising liquid and gas coking products; and k. recovering petroleum green coke from the coking unit.

12. The process of claim 11 wherein the coke has bulk density in the range 720-800 Kg/m$^3$.

13. The process of claim 11 wherein the coke contains sulfur in the range 1 to 2.5 W %.

14. The process of claim 11 wherein the coke contains nickel up to 200 ppmw.

15. The process of claim 11 wherein the coke contains vanadium up to 350 ppmw.

16. The process of claim 11 wherein the coke contains volatile combustible material up to 0.5 W %.

17. The process of claim 11 wherein the deasphalted oil is heated in a furnace of the coking unit to a temperature in the range of 480° C. to 530° C.

18. The process of claim 11 wherein the coker unit is a delayed coker unit.

19. The process of claim 18, wherein the coker unit is configured with two or more parallel drums and is operated in a swing mode, and wherein the process is continuous.

20. The process of claim 11, wherein the petroleum green coke recovered from the coker drum effective raw material for calcination into anode grade coke (sponge) or electrode grade coke (needle).

21. An integrated process that operates within the battery limits of a refinery for conversion of a feedstock containing hydrocarbons having a boiling point greater than 300° C. that includes solvent deasphalting and delayed coking, the process comprising:

a. introducing a heavy hydrocarbon feedstock containing asphaltenes into a mixing vessel with a $C_3$ to $C_7$ paraffinic solvent and a solid adsorbent material;

b. mixing the heavy hydrocarbon feedstock containing asphaltenes, paraffinic solvent and solid adsorbent material in the mixing vessel at a temperature and pressure that are below the critical pressure and temperature of the solvent in order to solvent-flocculate solid asphaltenes particles which include sulfur-containing and nitrogen-containing polynuclear aromatic molecules;

c. maintaining the heavy hydrocarbon feedstock, solvent-flocculated asphaltenes, paraffinic solvent, and adsorbent material in the mixing vessel for a time sufficient to adsorb the sulfur-containing and nitrogen-containing polynuclear aromatic molecules on the adsorbent material;

d. separating the solid phase comprising asphaltenes and adsorbent material from the liquid phase comprising deasphalted oil and paraffinic solvent;

e. passing the solid phase comprising asphaltenes and adsorbent material to a filtration vessel with an aromatic or polar solvent to desorb the adsorbed sulfur-containing and nitrogen-containing compounds and to recover the solid asphalt phase and regenerated adsorbent material;

f. passing the aromatic or polar solvent mixture containing desorbed sulfur-containing and nitrogen-containing polynuclear aromatic molecules to a fractionator to recover the aromatic or polar solvent;

g. passing the liquid phase comprising deasphalted oil and paraffinic solvent to a separation vessel to separate the deasphalted oil and paraffinic solvent and recovering the solvent for recycling to the mixing vessel;

h. heating the deasphalted oil to delayed coking temperatures in a coking unit furnace and passing the heated deasphalted oil to a delayed coking drum;

i. recovering a delayed coking product stream from the delayed coking drum comprising liquid and gas coking products; and j. recovering petroleum green coke from the delayed coking drum.

22. The process of claim 21 wherein the coke has bulk density in the range 720-800 Kg/m$^3$.

23. The process of claim 21 wherein the coke contains sulfur in the range 1 to 2.5 W %.

24. The process of claim 21 wherein the coke contains nickel up to 200 ppmw.

25. The process of claim 21 wherein the coke contains vanadium up to 350 ppmw.

26. The process of claim 21 wherein the coke contains volatile combustible material up to 0.5 W %.

27. The process of claim 21 wherein the deasphalted oil is heated in a furnace of the coking unit to a temperature in the range of 480° C. to 530° C.

28. The process of claim 21 wherein the coker unit is a delayed coker unit.

29. The process of claim 28, wherein the coker unit is configured with two or more parallel drums and is operated in a swing mode, and wherein the process is continuous.

30. The process of claim 21, wherein the petroleum green coke recovered from the coker drum effective raw material for calcination into anode grade coke (sponge) or electrode grade coke (needle).

31. An integrated process for conversion of a feedstock containing hydrocarbons having a boiling point greater than 300° C. that includes solvent deasphalting and delayed coking, the process comprising:

a. introducing a heavy hydrocarbon feedstock containing asphaltenes into a first separation zone with a $C_3$ to $C_7$ paraffinic solvent at a temperature and pressure that are below the critical pressure and temperature of the solvent in order to solvent-flocculate solid asphaltenes particles which include sulfur-containing and nitrogen-containing polynuclear aromatic molecules;

b. recovering an asphalt stream from the first separation zone;

c. introducing a solid adsorbent material into a mixed deasphalted oil and paraffinic solvent stream recovered from the first separation zone and passing the deasphalted oil, adsorbent, and paraffinic solvent mixture to a second separation zone;

d. adsorbing remaining solid asphaltenes particles from the mixed deasphalted oil and paraffinic solvent by contacting the adsorbent material with the mixed deasphalted oil and paraffinic solvent stream for a time sufficient to adsorb sulfur-containing and nitrogen-containing polynuclear aromatic molecules on the adsorbent material;

e. separating the paraffinic solvent from the deasphalted oil and adsorbent material and recovering the solvent for recycling to the first separation zone;

f. passing the deasphalted oil and adsorbent mixture from the second separation zone to a filtration vessel with an aromatic or polar solvent to desorb the adsorbed sulfur-containing and nitrogen-containing polynuclear aromatic compounds from the adsorbent material and to recover regenerated adsorbent material and spent adsorbent including sulfur-containing and nitrogen-containing polynuclear aromatic compounds;

g. passing the deasphalted oil and aromatic or polar solvent mixture to a fractionator to recover separate solvent and deasphalted oil streams;

h. heating the deasphalted oil from the fractionator to delayed coking temperatures in a coking unit furnace and passing the heated deasphalted oil to a delayed coking drum;

i. recovering liquid and gas coking products from the delayed coking drum; and j. recovering petroleum green coke from the delayed coking drum.

32. The process of claim 31 wherein the coke has bulk density in the range 720-800 $Kg/m^3$.

33. The process of claim 31 wherein the coke contains sulfur in the range 1 to 2.5 W %.

34. The process of claim 31 wherein the coke contains nickel up to 200 ppmw.

35. The process of claim 31 wherein the coke contains vanadium up to 350 ppmw.

36. The process of claim 31 wherein the coke contains volatile combustible material up to 0.5 W %.

37. The process of claim 31 wherein the deasphalted oil is heated in a furnace of the coking unit to a temperature in the range of 480° C. to 530° C.

38. The process of claim 31 wherein the coker unit is a delayed coker unit.

39. The process of claim 38, wherein the coker unit is configured with two or more parallel drums and is operated in a swing mode, and wherein the process is continuous.

40. The process of claim 31, wherein the petroleum green coke recovered from the coker drum effective raw material for calcination into anode grade coke (sponge) or electrode grade coke (needle).

* * * * *